US011892225B2

(12) United States Patent
Miller et al.

(10) Patent No.: US 11,892,225 B2
(45) Date of Patent: Feb. 6, 2024

(54) SYSTEMS AND METHODS OF OPERATING REFRIGERATOR APPLIANCES

(71) Applicant: Haier US Appliance Solutions, Inc., Wilmington, DE (US)

(72) Inventors: Larry Eugene Miller, Louisville, KY (US); William Arnold Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/731,679

(22) Filed: Apr. 28, 2022

(65) Prior Publication Data

US 2023/0349625 A1 Nov. 2, 2023

(51) Int. Cl.
*F25D 21/04* (2006.01)
*F25D 21/00* (2006.01)

(52) U.S. Cl.
CPC ..... *F25D 21/04* (2013.01); *F25D 21/006* (2013.01); *F25D 2400/02* (2013.01); *F25D 2400/06* (2013.01)

(58) Field of Classification Search
CPC .... F25D 21/04; F25D 21/006; F25D 2400/02; F25D 2400/06
See application file for complete search history.

(56) References Cited

U.S. PATENT DOCUMENTS

2004/0104654 A1* 6/2004 Lee ..... F25D 23/10 312/401
2005/0011220 A1* 1/2005 Hallin ..... F25B 39/026 62/526
2005/0016198 A1* 1/2005 Wowk ..... A01N 1/0268 62/457.2
2010/0275631 A1 11/2010 Wiest et al.
2012/0023975 A1* 2/2012 Yoon ..... F25D 11/022 62/81
2012/0260690 A1* 10/2012 Miyamoto ..... F25D 21/08 219/539
2013/0312439 A1* 11/2013 Howell ..... F25D 29/00 62/89
2014/0216706 A1* 8/2014 Melton ..... F25D 21/04 165/223
2015/0135761 A1* 5/2015 Jang ..... F25D 21/04 62/441
2017/0108266 A1* 4/2017 Kim ..... F25D 11/02
2017/0211871 A1* 7/2017 Herrera ..... F25D 21/14
2018/0187947 A1* 7/2018 Chae ..... F25D 21/04
2018/0195792 A1* 7/2018 Segawa ..... F25D 23/087
(Continued)

FOREIGN PATENT DOCUMENTS

DE 102013015414 A1 2/2015
JP 5722057 B2 5/2015
KR 102188231 B1 12/2020

*Primary Examiner* — Nelson J Nieves
(74) *Attorney, Agent, or Firm* — Dority & Manning, P.A.

(57) ABSTRACT

A side-by-side refrigerator system includes a first refrigerated cabinet and a second refrigerated cabinet alongside the first refrigerated cabinet. A heater is positioned within a wall of one of the first refrigerated cabinet and the second refrigerated cabinet. A controller is configured to constantly operate the heater during a side-by-side operating mode. The controller is disposed within the one of the first refrigerated cabinet and the second refrigerated cabinet.

16 Claims, 7 Drawing Sheets

(56) References Cited

U.S. PATENT DOCUMENTS

| | | | | |
|---|---|---|---|---|
| 2020/0173708 | A1* | 6/2020 | Kim | F25D 21/004 |
| 2020/0340730 | A1* | 10/2020 | Kawanami | F25D 29/00 |
| 2020/0408472 | A1* | 12/2020 | Bae | F28F 9/013 |
| 2021/0123655 | A1* | 4/2021 | Khizar | F25D 21/08 |
| 2021/0190406 | A1* | 6/2021 | Seo | F25D 11/02 |
| 2021/0247127 | A1* | 8/2021 | Park | F25D 19/04 |
| 2022/0282901 | A1* | 9/2022 | Kim | F25D 17/062 |

* cited by examiner

SYSTEMS AND METHODS OF OPERATING REFRIGERATOR APPLIANCES

FIELD OF THE INVENTION

The present subject matter relates generally to methods for operating refrigerators, specifically built-in refrigerators.

BACKGROUND OF THE INVENTION

Built-in refrigerators are assembled into the existing cabinetry and provide a high-end look. There are different types of built-in refrigerators, such as integrated refrigerators and panel-ready refrigerators. Built-in refrigerators can either have a stainless steel front or a custom panel front to match existing cabinetry. Built-in refrigerators also come in a variety of sizes and styles, such as a bottom freezer, French-door, side-by-side, and column. Column style built-in refrigerators are all-fresh food or all-freezer appliances that can be installed together or apart and are fully customizable.

In the case of side-by-side columns, the temperature difference between the freezer column and the refrigerator column can cause condensation to form on the exterior of the columns, and the condensation can lead to water damage behind the appliance. Current models on the market reduce condensation with additional, separate heaters installed on the exterior of the columns, however such heaters are a costly solution.

BRIEF DESCRIPTION OF THE INVENTION

Aspects and advantages of the invention will be set forth in part in the following description, or may be apparent from the description, or may be learned through practice of the invention.

In one example embodiment, a side-by-side refrigerator system includes a first refrigerated cabinet and a second refrigerated cabinet alongside the first refrigerated cabinet. A heater is positioned within a wall of one of the first refrigerated cabinet and the second refrigerated cabinet. A controller is configured to constantly operate the heater during a side-by-side operating mode. The controller is disposed within the one of the first refrigerated cabinet and the second refrigerated cabinet.

In another example embodiment, an integrated side-by-side refrigerator system includes a first refrigerated cabinet that defines a freezer column. The side-by-side refrigerator system also includes a second refrigerated cabinet that defines a fresh food column. The first refrigerated cabinet and the second refrigerated cabinet collectively form the integrated side-by-side refrigerator system. A heater is positioned within a wall of one of the first refrigerated cabinet and the second refrigerated cabinet. A controller is configured to constantly operate the heater during a side-by-side operating mode. The controller is disposed within the one of the first refrigerated cabinet and the second refrigerated cabinet.

In another example embodiment, a method of operating a side-by-side refrigerator system includes receiving, at a controller, a signal indicative of activation of the side-by-side refrigerator system. Then, determining, at the controller, an operating mode of the side-by-side refrigerator system. Then, adjusting, at the controller, the operating state of a heater that is positioned within a wall of the side-by-side refrigerator system. The operating mode of the side-by-side refrigerator system is configured for constantly operating the heater during the side-by-side operating mode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
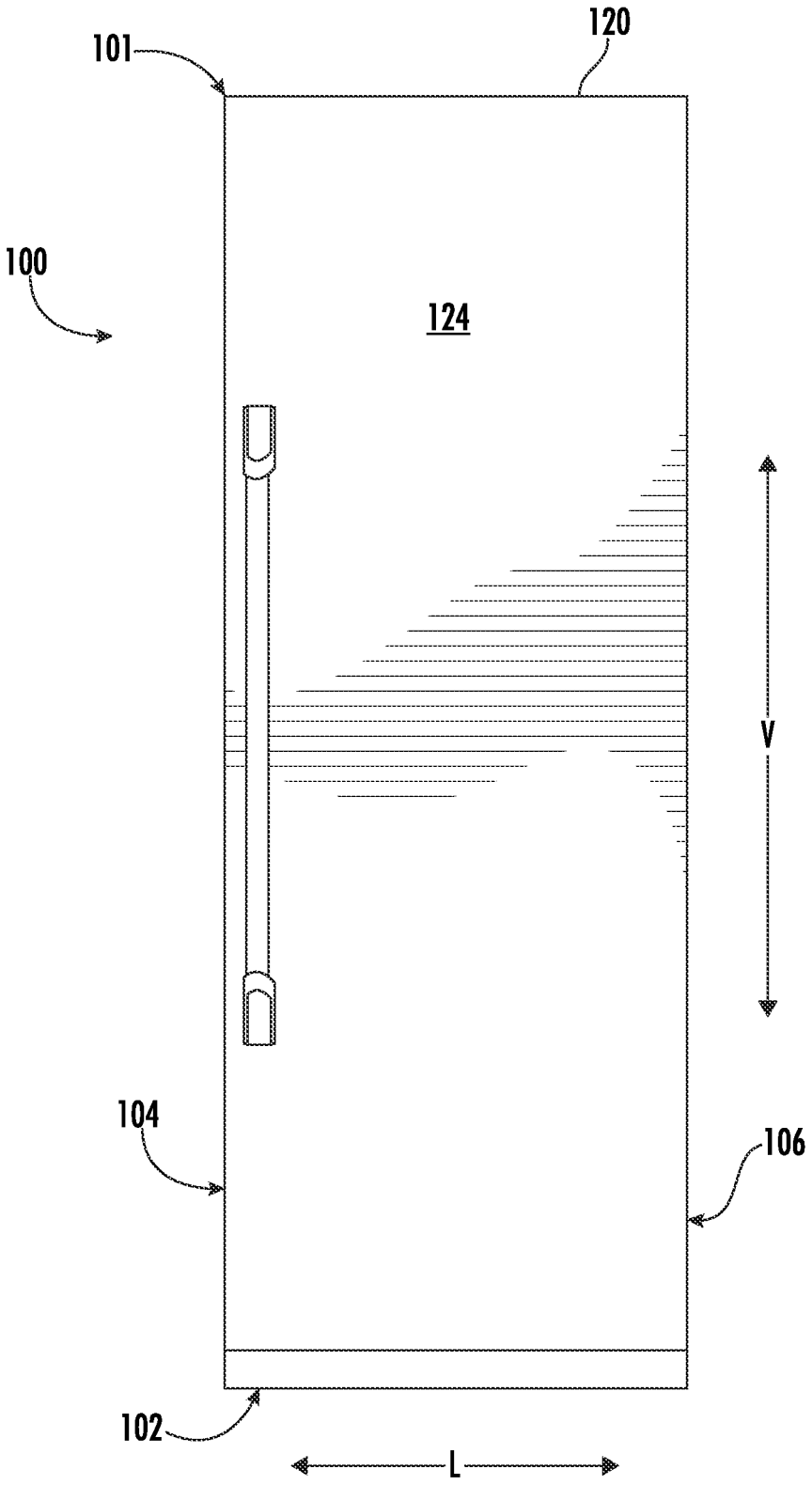
FIG. 1 provides a front elevation view of a refrigerator appliance according to an example embodiment of the present disclosure with a door of the refrigerator appliance shown in the closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "left," "right," "front," "back," "top," or "bottom" are used with reference to the perspective of a user accessing the refrigerator appliance. For example, a user stands in front of the refrigerator to open the door(s) and reaches into the food storage chamber(s) to access items therein.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise, or counterclockwise.

Figure 2:
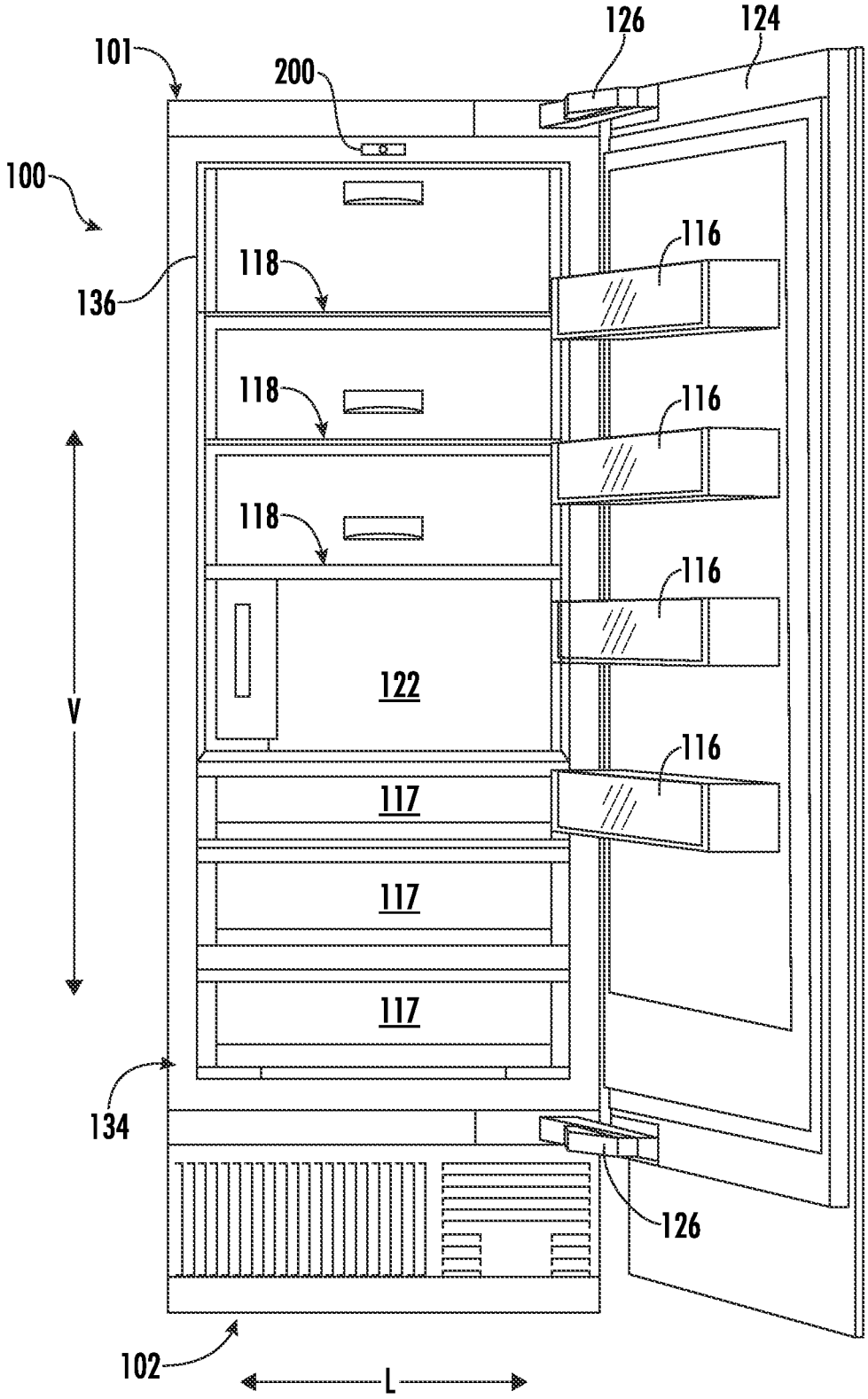
FIG. 2 provides a front elevation view of the example refrigerator appliance of FIG. 1 with the door shown in an open position.
Figure 3:
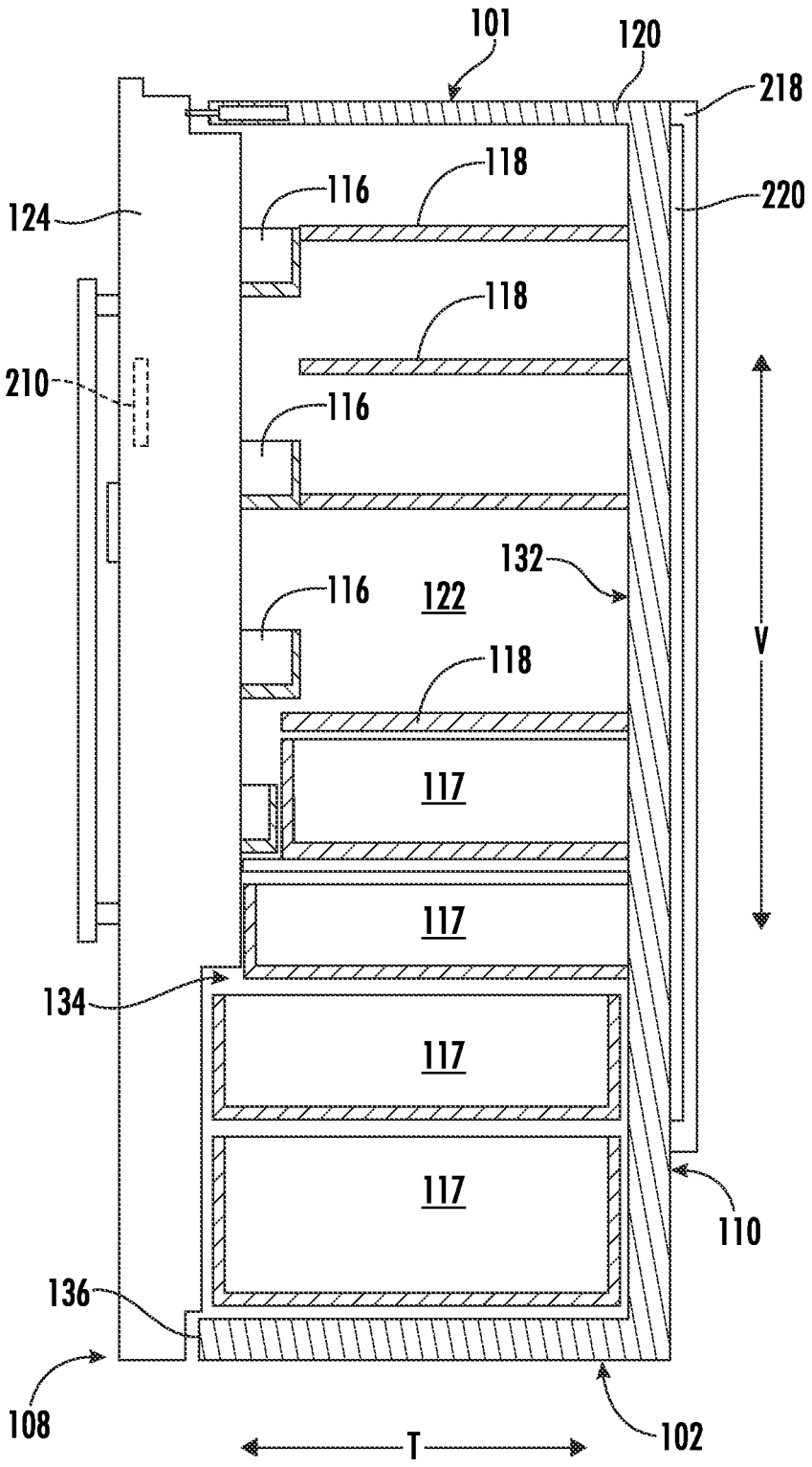
FIG. 3 provides a section view of the example refrigerator appliance of FIG. 1.

As illustrated in FIGS. 1 through 3, an example refrigerator appliance 100 has an insulated housing or cabinet 120 that defines a food storage chamber 122. A door 124 is provided to selectively sealingly enclose the food storage chamber 122 when in a closed position (FIG. 1) and provide access to the food storage chamber 122 when in an open position (FIG. 2). The door 124 is rotatably mounted to the cabinet 120, such as by one or more hinges 126 (FIG. 2), to rotate between the open position and the closed position.

Refrigerator appliance 100 defines a vertical direction V, a lateral direction L, and a transverse direction T (FIG. 3), each mutually perpendicular to one another. As may be seen in FIGS. 1 through 3, the cabinet 120 extends between a top portion 101 and a bottom portion 102 along the vertical direction V, between a left side portion 104 and a right side portion 106 along the lateral direction L, and between a front portion 108 (FIG. 3) and a rear portion 110 (FIG. 3) along the transverse direction T. As may be seen in FIGS. 2 and 3, the food storage chamber 122 extends between a front portion 134 and a back portion 132 along the transverse direction T. The front portion 134 of the food storage chamber 122 defines an opening 136 for receipt of food items. The food storage chamber 122 is a chilled chamber 122 for receipt of food items for storage. As used herein, the chamber may be "chilled" in that the chamber is operable at temperatures below room temperature, e.g., less than about seventy-five degrees Fahrenheit (75° F.), such as less than thirty-four degrees Fahrenheit (34° F.). One of ordinary skill in the art will recognize that the food storage chamber 122 may be chilled by a sealed refrigeration system, such that the food storage chamber 122 may be operable at or about the temperatures described herein by providing chilled air from the sealed system. The structure and function of such sealed systems are understood by those of ordinary skill in the art and are not described in further detail herein for the sake of brevity and clarity.

Refrigerator door 124 is rotatably mounted, e.g., hinged, to an edge of cabinet 120 for selectively accessing the food storage chamber 122 within the cabinet 120. Refrigerator door 124 may be mounted to the cabinet 120 at or near the front portion 134 of the food storage chamber 122 such that the door 124 moves, e.g., rotates via hinges 126, between the closed position (FIG. 1) and the open position (FIG. 2). In the closed position of FIG. 1, the door 124 sealingly encloses the food storage chamber 122. Additionally, one or more gaskets and other sealing devices, which are not shown but will be understood by one of ordinary skill in the art, may be provided to promote sealing between the door 124 and the cabinet 120. In the open position of FIG. 2, the door 124 permits access to the food storage chamber 122.

As shown for example in FIGS. 2 and 3, various storage components may be mounted within the food storage chamber 122 to facilitate storage of food items therein as will be understood by those skilled in the art. In particular, the storage components include bins 116, drawers 117, and shelves 118 that are mounted within food storage chamber 122. Bins 116, drawers 117, and shelves 118 are configured for receipt of food items (e.g., beverages and/or solid food items) and may assist with organizing such food items.

As depicted, cabinet 120 defines a single chilled food storage chamber 122 for receipt of food items for storage. In the present example, the single chilled food storage chamber 122 is a fresh food chamber. In additional embodiments, the chilled chamber may be a freezer chamber, such as freezer chamber 422 (FIG. 5) and/or the refrigerator appliance 100 may include one or more additional chilled chambers for receipt of various food items and storage of such items at various temperatures as desired. For example, the refrigerator appliance 100 may include one or more chilled chambers configured for deep freeze (e.g., at about 0° F. or less) storage, or configured for chilling, e.g., produce or wine, at relatively warmer temperatures such as about 60° F. or more (while still below room temperature, as noted above), as well as any suitable temperatures between the stated examples. In various example embodiments, the chilled chamber 122 may be selectively operable at any number of various temperatures and/or temperature ranges as desired or required per application, and/or the refrigerator appliance 100 may include one or more additional chambers selectively operable at any suitable food storage temperature.

As may be seen in FIG. 3 a heater 220 may be incased in a foam block 218, e.g., at rear portion 110 of cabinet 120. However, heater 220 may be installed at other locations within cabinet 120 in alternative example embodiments, e.g., at left side portion 104 or right side portion 106 of cabinet 120. Heater 220 may be one of a plurality of heaters, e.g., installed at various locations within cabinet 120, and may be activated to prevent dew or condensation from forming on refrigerator appliance 100. Heater 220 may be controlled by a controller 210. As known in the art, controller 210 may be configured to operate heater 220 under a humidity control setting to prevent dew or condensation from forming on refrigerator appliance 100. Humidity control settings are understood by those of ordinary skill in the art and are not described in further detail herein for the sake of brevity and clarity.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 210 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 210 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 210 may be operable to execute programming instructions or micro-control code associated with an operating mode of refrigerator appliance 100. In this regard, the instructions may be software or any set of instructions that when executed by the processing device, cause the processing device to perform operations, such as running one or more software applications. Moreover, it should be noted that controller 210 as disclosed herein is capable of and may be operable to perform any methods, method steps, or portions of methods as disclosed herein. For example, in some embodiments, methods disclosed herein may be embodied in programming instructions stored in the memory and executed by controller 210.

The illustrated example refrigerator appliance 100 is generally referred to as a single-door or single-purpose refrigerator, also referred to as a column refrigerator. It is recognized, however, that the benefits of the present disclosure apply to other types and styles of refrigerators such as, for example, a bottom mount refrigerator, a top mount refrigerator, a side-by-side style refrigerator, or a freezer appliance. Consequently, the description set forth herein is for illustrative purposes only and is not intended to be limiting in any aspect to a particular refrigerator chamber configuration.

Figure 4:
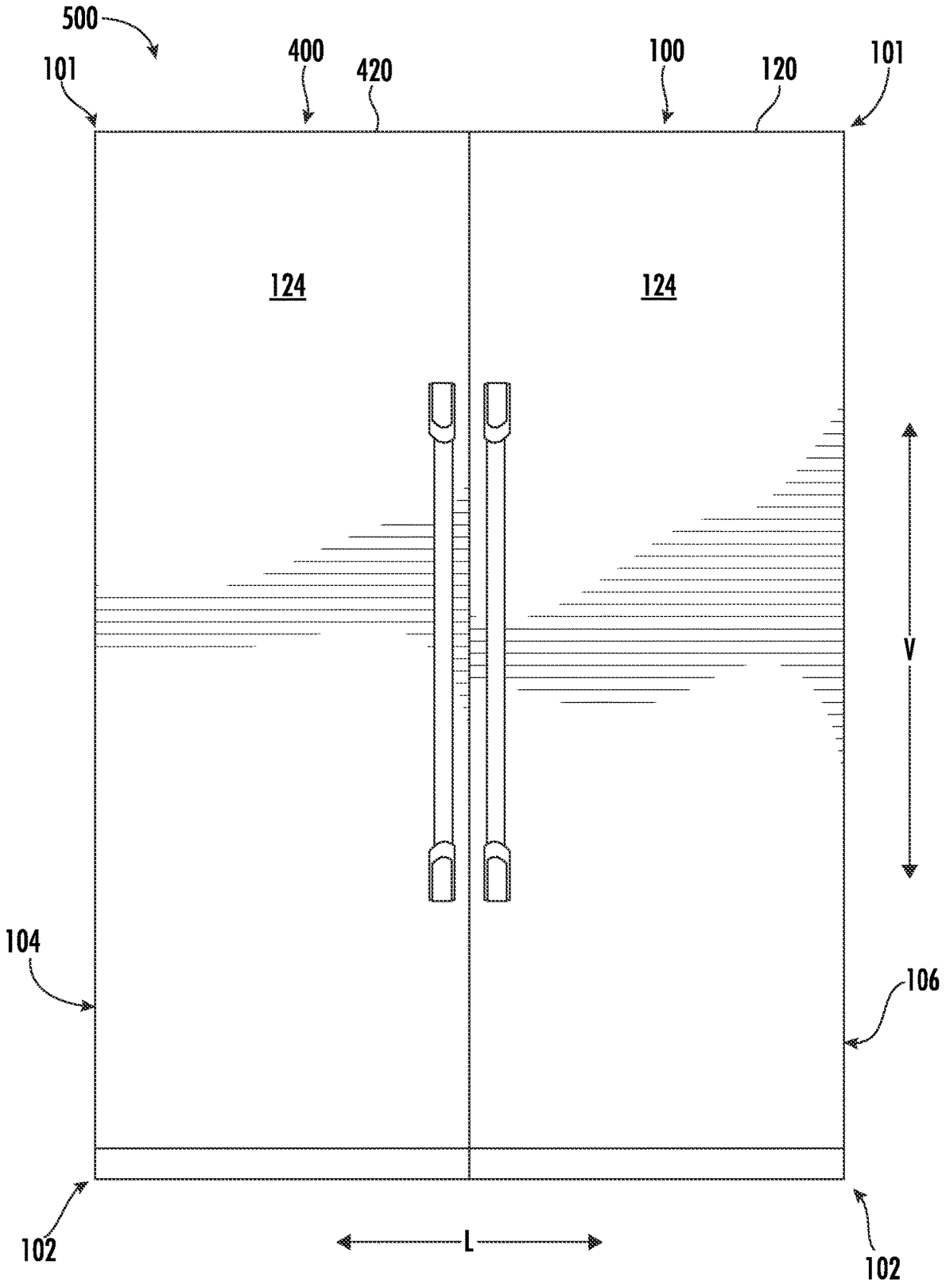
FIG. 4 provides a front elevation view of a side-by-side refrigerator system according to an example embodiment of the present disclosure with both doors of the side-by-side refrigerator system shown in the closed position.
Figure 5:
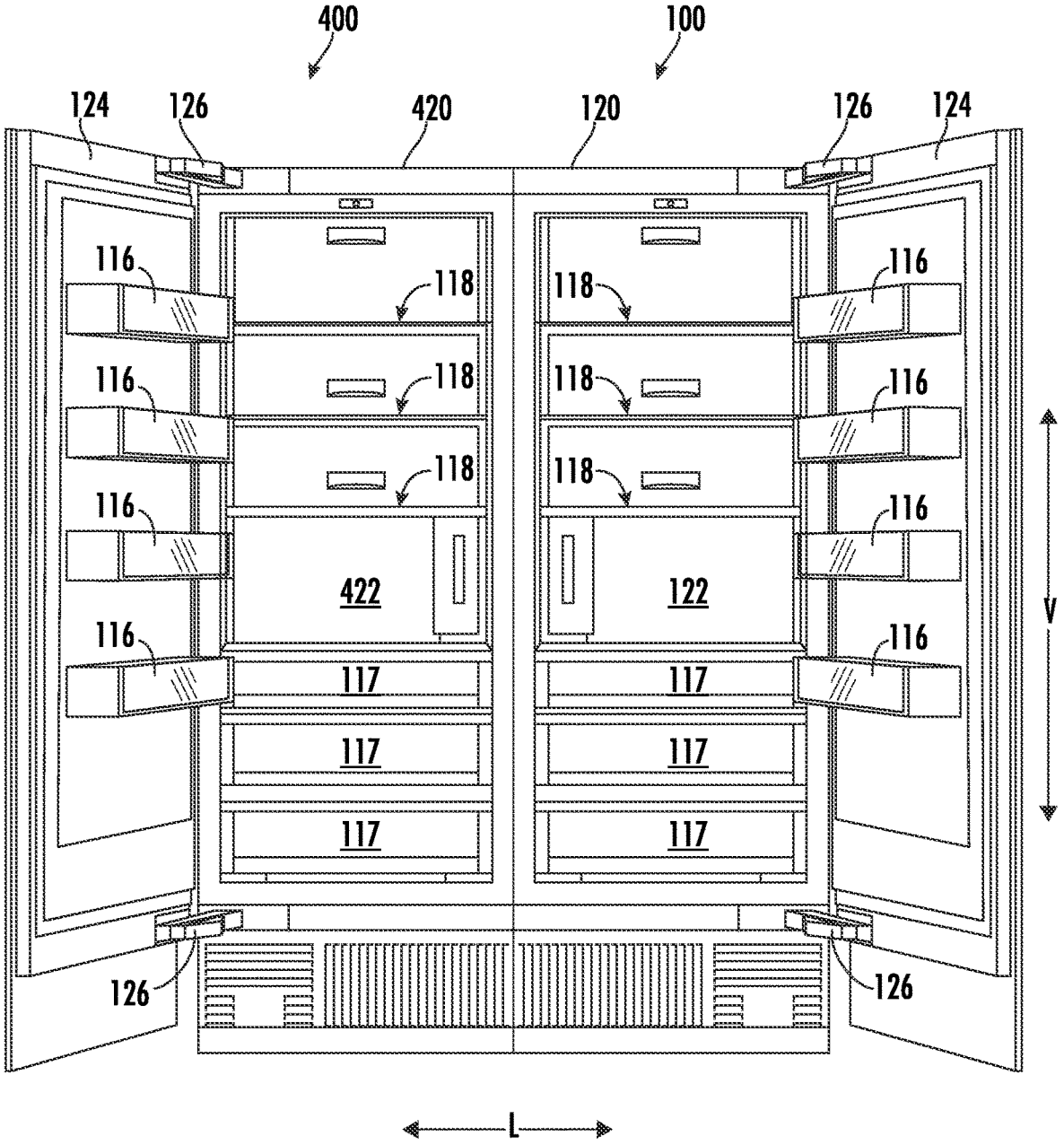
FIG. 5 provides a front elevation view of the example side-by-side refrigerator system of FIG. 4 with both doors shown in an open position.
Figure 6:
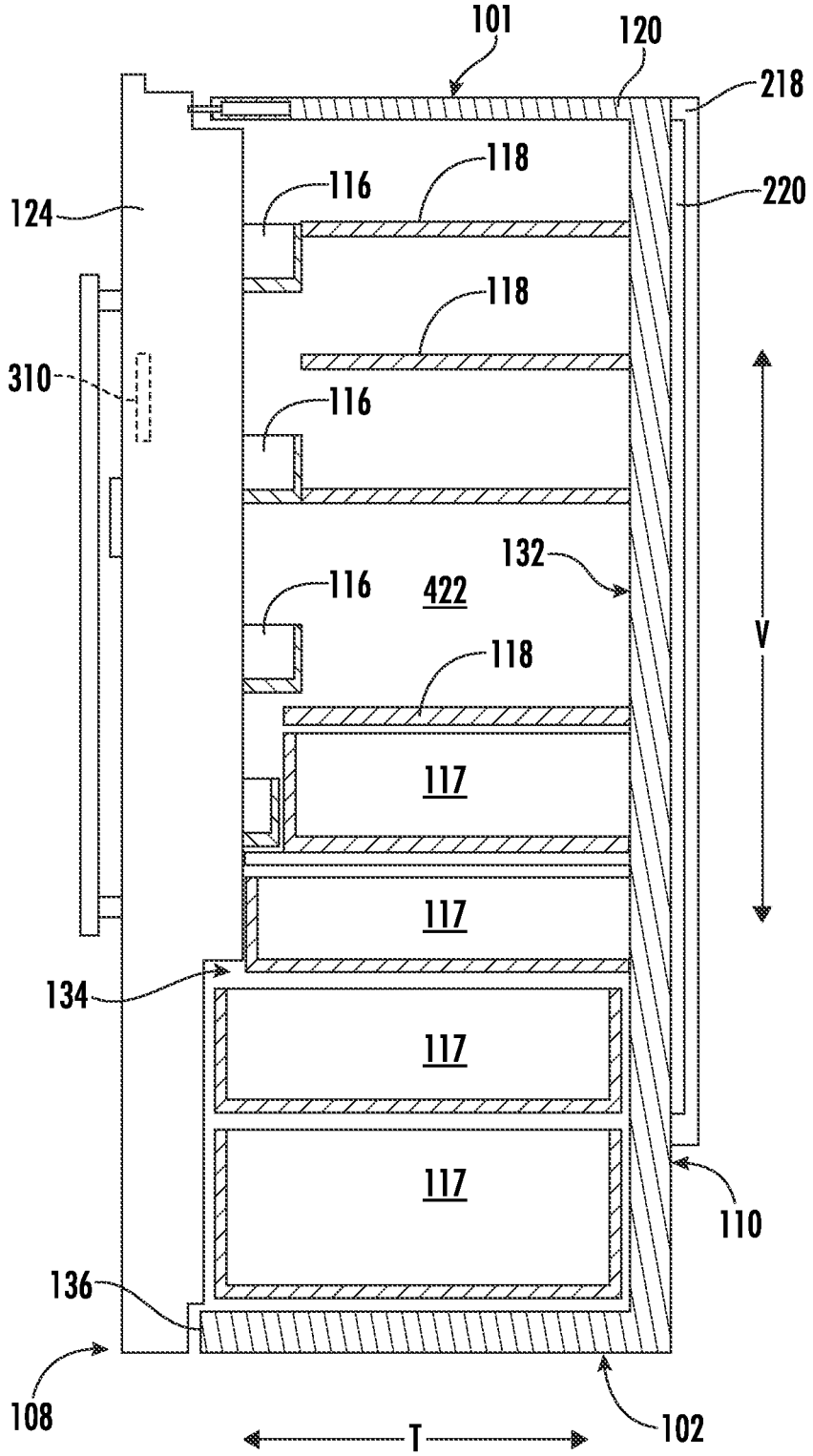
FIG. 6 provides a cross-section view of the example side-by-side refrigerator system of FIG. 4.
Figure 7:
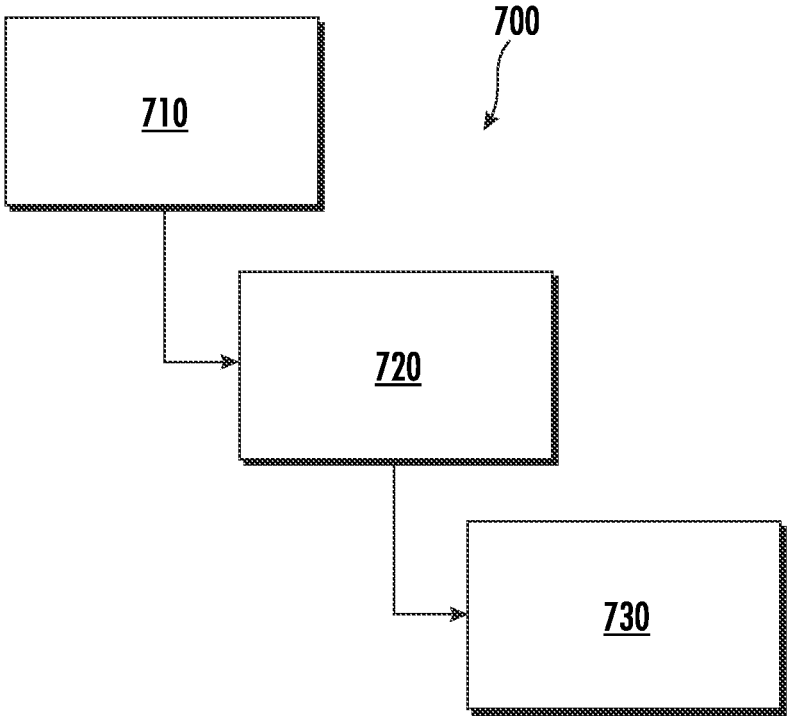
FIG. 7 provides a method of operating a side-by-side refrigerator system according to an example embodiment of the present disclosure.

FIGS. 4-6 illustrate refrigerator appliance 100 in combination with a freezer appliance 400, each a respective column refrigerator. The combination of refrigerator appliance 100 and freezer appliance 400 may collectively form a side-by-side refrigerator system 500. Cabinet 120 may be referred to as a first refrigerated cabinet 120 and a cabinet 420 may be referred to as a second refrigerated cabinet 420. Side-by-side refrigerator system 500 may be integrated into surrounding cabinetry in a kitchen or other suitable location. Door 124 on both the refrigerator appliance 100 and freezer appliance 400 may have cabinetry panels mounted to door 124 to appear seamless with any surrounding cabinetry. Similar to refrigerator appliance 100, side-by-side refrigerator system 500 may extend between a top portion 101 and a bottom portion 102 along the vertical direction V, between a left side portion 104 and a right side portion 106 along the lateral direction L, and between a front portion 108 (FIG. 6) and a rear portion 110 (FIG. 6) along the transverse direction T. As may be seen in FIGS. 5 and 6, a freezer chamber 422 extends between a front portion 134 and a back portion 132 along the transverse direction T.

In the current example embodiment shown in FIGS. 4-6, the storage components mounted within freezer chamber 422 includes bins 116, drawers 117, and shelves 118 similar to those that are mounted within food storage chamber 122. This configuration for freezer chamber 422 is provided for example purposes only and other configurations, i.e., combination, distribution, or placement of such bins 116, drawers 117, and shelves 118 are possible and will be understood by those skilled in the art.

As may be seen in FIG. 6 a heater 220 may be incased in a foam block 218. Heater 220 may be one of a plurality of heaters and may be activated to prevent dew or condensation from forming on side-by-side refrigerator system 500. As mentioned above, heater 220 may be controlled by controller 210. In the present example embodiment, controller 210 may be configured to constantly operate heater 220 during a side-by-side operating mode to prevent dew or condensation from forming on refrigerator appliance 100, e.g., between and/or behind refrigerator appliance 100 and freezer appliance 400. The side-by-side operating mode may be implemented in controller 210 during the installation of side-by-side refrigerator system 500 into a kitchen or other user desired location, e.g., such that the side-by-side operating mode is selected when refrigerator appliance 100 and freezer appliance 400 are installed side-by-side. The side-by-side operating mode is detailed herein in a method 700. Each of the refrigerator appliance 100 and freezer appliance 400 may have a controller 210, i.e., freezer appliance 400 may have an additional controller 210, with respect to side-by-side refrigerator system 500.

Method 700 may be used to operate a side-by-side refrigerator system, such as side-by-side refrigerator system 500. At 710, controller 210 may receive a signal indicative of activation of side-by-side refrigerator system 500, i.e., a signal that side-by-side refrigerator system 500 has been turned on. Then at 720, controller 210 determines the operating mode installed or selected for the side-by-side refrigerator system. In a dual-installation, or in a side-by-side refrigerator system 500, the side-by-side operating mode may be installed when refrigerator appliance 100 and freezer appliance 400 are installed side-by-side. Once the operating mode is determined, at 730, controller 210 may adjust the operating state of heater 220. In the current example embodiment, since the operating mode installed in controller 210 of side-by-side refrigerator system 500 is configured for constantly operating heater 220 during the side-by-side operating mode, heater 220 may constantly operate to prevent dew and condensation from forming on the side-by-side refrigerator system 500. If in a single column installation, as detailed in FIGS. 1-3, the controller may not have the side-by-side operating mode installed and may function under the humidity control settings, e.g., such that heater 220 does not constantly operate.

Included with side-by-side refrigerator system 500 may be various trims and other components. The trims may be installed between refrigerator appliance 100 and freezer appliance 400, e.g., to cover the gap between refrigerator appliance 100 and freezer appliance 400. Moreover, the side-by-side refrigerator system 500 may include a flash drive, or standardized utility module (SUM module) that includes a software update for activating the side-by-side operating mode, also referred to as "dual install mode" for the heater 220. Thus, the side-by-side operating mode may not be a default operating mode in certain example embodiments. The installed software update for the side-by-side operating mode may adjust operation the heater 220 from a default operation state (e.g., in which heater 220 operates periodically or intermittently) to the constant operation state as detailed above. During the installation of side-by-side refrigerator system 500, an installer may be instructed to permit the software of side-by-side refrigerator system 500 to be updated prior to completing the installation. The update would desirably occur after the columns, i.e., refrigerator appliance 100 and freezer appliance 400, are combined and setup. The software update may be one of the final steps of the installation of side-by-side refrigerator system 500.

As may be seen from the above, a side-by-side refrigerator system 500 may have a side-by-side operating mode that may turn heater 220 from a humidity control setting to a state of constant operation. With heater 220 constantly operating, dew and condensation may not be able to form from the temperature difference between refrigerator appliance 100 and freezer appliance 400. The side-by-side operating mode may advantageously eliminate the use of known additional components or kits a user may have to acquire in addition to the side-by-side refrigerator system 500. Thus, reducing consumer cost, as well as manufacturing/installation costs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A side-by-side refrigerator system, comprising:

a first refrigerated cabinet;

a second refrigerated cabinet alongside the first refrigerated cabinet;

a heater positioned within a wall of one of the first refrigerated cabinet and the second refrigerated cabinet; and a controller configured to constantly operate the heater during a side-by-side operating mode, the controller disposed within the one of the first refrigerated cabinet and the second refrigerated cabinet, wherein the first refrigerated cabinet and the second refrigerated cabinet are each a respective column unit.

2. The side-by-side refrigerator system of claim 1, wherein the first and second refrigerated cabinets collectively form a built-in or integrated refrigerator appliance.

3. The side-by-side refrigerator system of claim 2, wherein the first refrigerated cabinet is a freezer column, and the second refrigerated cabinet is a fresh food column.

4. The side-by-side refrigerator system of claim 1, further comprising the heater encased in foam within the wall of one of the first refrigerated cabinet and the second refrigerated cabinet.

5. The side-by-side refrigerator system of claim 4, further comprising an additional heater positioned within a wall of the other of the first refrigerated cabinet and the second refrigerated cabinet.

6. The side-by-side refrigerator system of claim 5, further comprising an additional controller configured to constantly operate the additional heater during the side-by-side operating mode.

7. An integrated side-by-side refrigerator system, comprising:

a first refrigerated cabinet defining a freezer column;

a second refrigerated cabinet defining a fresh food column, the first refrigerated cabinet and the second refrigerated cabinet collectively form the integrated side-by-side refrigerator system;

a heater positioned within a wall of one of the first refrigerated cabinet and the second refrigerated cabinet; and a controller configured to constantly operate the heater during a side-by-side operating mode, the controller disposed within the one of the first refrigerated cabinet and the second refrigerated cabinet, wherein the first refrigerated cabinet and the second refrigerated cabinet are each a respective column unit.

8. The integrated side-by-side refrigerator system of claim 7, further comprising the heater encased in foam within the wall of one of the first refrigerated cabinet and the second refrigerated cabinet.

9. The integrated side-by-side refrigerator system of claim 8, further comprising an additional heater positioned within a wall of the other of the first refrigerated cabinet and the second refrigerated cabinet.

10. The integrated side-by-side refrigerator system of claim 9, further comprising an additional controller configured to constantly operate the additional heater during the side-by-side operating mode.

11. A method of operating a side-by-side refrigerator system, comprising:

receiving, at a controller, a signal indicative of activation of the side-by-side refrigerator system;

determining, at the controller, an operating mode of the side-by-side refrigerator system; and adjusting, at the controller, an operating state of a heater positioned within a wall of the side-by-side refrigerator system, wherein the first refrigerated cabinet and the second refrigerated cabinet are each a respective column unit, wherein the operating mode of the side-by-side refrigerator system is configured for constantly operating the heater during the side-by-side operating mode.

12. The method of claim 11, further comprising a first refrigerated cabinet and a second refrigerated cabinet, the first and second refrigerated cabinets collectively form a built-in or integrated refrigerator appliance.

13. The method of claim 12, wherein the first refrigerated cabinet is a freezer column, and the second refrigerated cabinet is a refrigerator column.

14. The method of claim 12, further comprising the heater encased in foam within a wall of one of the first refrigerated cabinet and the second refrigerated cabinet.

15. The method of claim 14, further comprising an additional heater positioned within a wall of the other of the first refrigerated cabinet and the second refrigerated cabinet.

16. The method of claim 14, further comprising an additional controller configured to constantly operate the additional heater during the side-by-side operating mode.

* * * * *